US006302609B1

(12) United States Patent
Machida et al.

(10) Patent No.: US 6,302,609 B1
(45) Date of Patent: Oct. 16, 2001

(54) BALLPOINT PEN REFILL

(75) Inventors: Minoru Machida; Kazuhiko Sasaki, both of Isesaki (JP)

(73) Assignee: Kabushiki Kaisha Pilot, Tokyo-To (JP)

( * ) Notice: Subject to any disclaimer, the term of this patent is extended or adjusted under 35 U.S.C. 154(b) by 0 days.

(21) Appl. No.: 09/485,856

(22) PCT Filed: Jun. 4, 1999

(86) PCT No.: PCT/JP99/03009

§ 371 Date: Feb. 17, 2000

§ 102(e) Date: Feb. 17, 2000

(87) PCT Pub. No.: WO99/65705

PCT Pub. Date: Dec. 23, 1999

(30) Foreign Application Priority Data

Jun. 17, 1998 (JP) ..... 10-186954

(51) Int. Cl.[7] ..... B43K 7/10

(52) U.S. Cl. ..... 401/142; 401/209; 401/216; 401/219

(58) Field of Search ..... 401/141, 142, 401/146–150, 180, 209, 214, 216, 217, 219, 220

(56) References Cited

U.S. PATENT DOCUMENTS

| | | | | |
|---|---|---|---|---|
| 3,082,740 | * | 3/1963 | Eckerle | 401/142 |
| 3,947,137 | * | 3/1976 | Hori | 401/217 |
| 4,973,180 | * | 11/1990 | Hori | 401/141 |
| 5,655,847 | * | 8/1997 | Kobayashi et al. | 401/219 |
| 5,709,493 | * | 1/1998 | Kobayashi et al. | 401/219 |
| 5,984,559 | * | 11/1999 | Shiobara et al. | 401/214 |

FOREIGN PATENT DOCUMENTS

| | | |
|---|---|---|
| 9-175078 | 7/1997 | (JP) . |
| 10-16473 | 1/1998 | (JP) . |
| 10-58887 | 3/1998 | (JP) . |

* cited by examiner

*Primary Examiner*—Steven O. Douglas
*Assistant Examiner*—Kathleen J. Prunner
(74) *Attorney, Agent, or Firm*—Wenderoth, Lind & Ponack, L.L.P.

(57) ABSTRACT

A ballpoint pen refill has an ink-accommodating tube (1) containing an ink (6) having a thixotropic property and a greaselike ink follower (7) capable of moving together with the ink (6) as the ink (6) is consumed so as to be contiguous with the rear end of the ink (6) to prevent the reverse flow of the ink (6). The ink-accommodating tube (1) has a small diameter portion (3) formed at a front side and a large diameter portion (2) having a diameter greater than the diameter of the small diameter portion (3) and extending rearward from the small diameter portion (3). A ballpoint pen tip (5) rotatably holding a ball (4) is inserted in the small diameter portion (3) of the ink-accommodating tube (1). A regulating member (15) has a column (15*a*) which is press-fitted in the small diameter portion (3). The column (15*a*) of the regulating member (15) has an inclined end surface (14) at its front end inclined at a predetermined angle to a plane perpendicular to the axis (O) of the ink-accommodating tube (1). The regulating member (15) is provided in its side surface (17) of the column (15*a*) with a fluid passage (18) extending rearward from the rear end of the inclined end surface (14) to enable the ink and air to flow therethrough in the ink-accommodating tube (1).

20 Claims, 3 Drawing Sheets

BALLPOINT PEN REFILL

BACKGROUND OF THE INVENTION

1. Technical Field

The present invention relates to a ballpoint pen refill having an ink-accommodating tube containing an ink having a thixotropic property and a greaselike ink follower directly put in the ink-accommodating tube so as to be in contact with the rear end of the ink to prevent the reverse flow of the ink and capable of advancing together with the rear end of the ink as the ink is consumed.

2. Description of Related Art

A ballpoint pen refill has an ink-accommodating tube containing an ink having a thixotropic property and a greaselike ink follower directly put therein so as to be in contact with the rear end of the ink to prevent the reverse flow of the ink and capable of advancing together with the rear end of the ink as the ink is consumed.

The ink having a thixotropic property is consumed at a consumption rate higher than that at which the oil ink of the ballpoint pen is consumed. Generally, the ink-accommodating tube has a large diameter portion containing the ink and a small diameter portion holding a ballpoint pen tip which rotatably holds a ball. Some ink-accommodating tubes are of a two-section construction having a large diameter portion and a small diameter portion such as mentioned above, and other ink-accommodating tubes are of a three-section construction having a big diameter portion, a small diameter portion and a medium diameter portion connecting the large diameter portion and the small diameter portion.

When such a ballpoint pen refill is impacted, the ink-accommodating tube and the ink tend to slide relative to each other. Consequently, an impulsive force resulting from the weight of the ink acts on the ink follower if the ballpoint pen tip is directed upward or the same impulsive force acts on the ball if the ballpoint pen tip is directed downward.

When the impulsive force acts on the ink follower, the impulsive force can be absorbed by the viscosity of the ink follower and the physical performance of the ink-accommodating tube, such as the wettability of the inner surface of the ink-accommodating tube with the ink follower.

When the impulsive force acts on the ball, the impulsive force is borne only by a front end edge of the ballpoint pen tip formed by spinning or the like so as to hold the ball in the ballpoint pen tip. In a ballpoint pen tip having a small ball, the wall thickness of the front end edge of the ballpoint pen tip holding the small ball is small and an exposed portion of the ball projecting from the front end edge is small and, therefore, the edge of the front end edge is liable to come into contact with a paper sheet.

Consequently, the front end edge is worn and the ability of the front end edge to hold the ball lessens as the ballpoint pen is used and, eventually, the ball falls off the front end edge when an impulsive force acts on the ball. The applicant of the present patent application have previously proposed an improved ballpoint pen refill particularly for a retractable-type ballpoint pen which is carried around with its ballpoint pen tip directed downward, capable of eliminating the possibility of falling of the ball off the front end edge in Japanese Laid-Open Publication No.175078/1997. This previously proposed ballpoint pen refill has an ink-accommodating tube provided with a ballpoint pen tip in a front end portion thereof, and a partition wall disposed behind the rear end surface of the ballpoint pen tip and provided with an ink passage.

When fabricating a ballpoint pen refill including an ink-accommodating tube containing an ink having a thixotropic property and a greaselike ink follower, air is entrapped in the ink when filling the ink and the ink follower in the ink-accommodating tube. If air stays in the ballpoint pen tip or the like, the ink is unable to flow through an ink passage or the flow of the ink is obstructed, and the ink is unable to run properly. Therefore, air entrapped in the ballpoint pen refill must be discharged outside. In a stationary state, both the ink and the ink follower are highly viscous, air entrapped in the ballpoint pen refill is unable to flow and to escape naturally from the ballpoint pen refill even if the ballpoint pen refill is held with the ballpoint pen tip directed downward.

Therefore, the ballpoint pen refill is mounted on the rotor of a centrifuge with the ballpoint pen tip directed radially outward and the rotor of the centrifuge is rotated to force the ink toward the ballpoint pen tip by centrifugal force so that air entrapped in the ballpoint pen refill is discharged outside forcibly through the open rear end of the ink-accommodating tube.

In the ballpoint pen refill provided with the partition wall disposed behind the ballpoint pen tip, air staying in a front end portion of the ink-accommodating tube in front of the partition wall is stopped by the front end surface of the partition wall when the ballpoint pen refill is turned on the centrifuge and air stays in the front end portion of the ink-accommodating tube. It was found that the flow of air toward the open rear end of the ink-accommodating tube is obstructed. Air cannot be discharged outside through the open rear end of the ink-accommodating tube. Air blocks the ink passage formed in the partition wall or an ink passage formed in the ballpoint pen tip to cause the unsatisfactory flow of the ink.

The present invention, which has an ink-accommodating tube containing an ink having a thixotropic property and a greaselike ink follower capable of moving together with the ink as the ink is consumed and of preventing the reverse flow of the ink, has been made in view of the above-mentioned problems. It is an object of the present invention to provide a ballpoint pen refill which is formed in a structure that can prevent the action of an impulsive force on a ball resulting from the weight of the ink due to the movement of the ink and the ink-accommodating tube relative to each other and that can prevent air which is entrapped in the ink when filling the ink and the ink follower in the ink-accommodating tube from staying in the ink-accommodating tube during a deaeration process for removing air entrapped in the ink from the ink-accommodating tube.

SUMMARY OF THE INVENTION

To achieve the object, the present invention provides a ballpoint pen refill which includes: an ink-accommodating tube containing an ink having a thixotropic property and a greaselike ink follower placed behind the ink adapted to move as the ink is consumed and to prevent the reverse flow of the ink, and having a small diameter portion formed at a front side and a large diameter portion formed at a rear side with a diameter larger than a diameter of the small diameter portion; a ballpoint pen tip inserted in a front end of the small diameter portion and rotatably holding a ball; and a regulating member having a column press-fitted in the small diameter portion. The regulating member includes an inclined end surface formed at a front end of the column and inclined at a predetermined angle to a plane perpendicular to an axis of the ink-accommodating tube, and a fluid passage extending rearward from a rear end of the inclined end surface along a side surface of the column to enable the ink and air in the ink-accommodating tube to flow therethrough.

Preferably, the predetermined angle is determined taking a magnitude of a centrifugal force to be exerted in a direction parallel to the axis of the ink-accommodating tube on the ink in a deaerating process for removing an air entrapped in the ink-accommodating tube and a viscosity of the filled in the ink-accommodating tube into consideration so that the air is not restrained from flowing by the inclined end surface in the deaerating process.

Preferably, the regulating member has a main portion located behind the column and having a diameter smaller than an inside diameter of the ink-accommodating tube and greater than a diameter of the column, and a tapered portion connecting the column and the main portion, the fluid passage extends from the rear end of the inclined end surface through the side surface of the column beyond a rear end of the column.

Preferably, the tapered portion is inserted in the ink-accommodating tube and is not in close contact with an inner surface of the ink-accommodating tube, and the fluid passage extends to at least a portion of the tapered portion.

Preferably, the ink-accommodating tube has a shoulder portion forming a transitional portion between the small diameter portion and the large diameter portion. A recess is formed on an outside surface of the shoulder portion to enable air filling a barrel to flow rearward when the ink-accommodating tube is inserted in the barrel. A projection is formed on the inner surface of the ink-accommodating tube at a position corresponding to the recess, and the tapered portion comes into contact with the projection so that a space is formed between the inner surface of the ink-accommodating tube and a surface of the tapered portion.

Preferably, the inclined end surface is formed as a flat surface.

Preferably, the inclined surface is formed as a convex conical surface projecting from the front end of the column.

Preferably, a plurality of fluid passages extend rearward from a rear end of the convex conical surface.

Preferably, the fluid passages are arranged at equal angular intervals about the axis of the ink-accommodating tube.

Preferably, the ballpoint pen tip is provided with a spring pressing the ball forward so as to press the ball closely against an inner surface of a front end of the ballpoint pen tip.

Preferably, the small diameter portion has a thin section with a front end in which the ballpoint pen tip is inserted, a medium section of a diameter greater than a diameter of the thin section and smaller than the diameter of the large diameter portion and connecting the thin section and the large diameter portion, and the column of the regulating member is press-fitted in the medium section.

Preferably, an end plug provided with a vent hole allowing air passage is fitted in an open rear end of the ink-accommodating tube.

In the ballpoint pen refill of the present invention with the regulating member, the regulating member prevents the action of an impulsive force resulting from the weight of the ink on the ball even if the ink and the ink-accommodating tube are forced to move relative to each other by an impulsive force exerted on the ballpoint pen refill.

when air, which was entrapped in the ink having a thixotropic property and the greaselike ink follower in the process of filling the ink having a thixotropic property and the ink follower in the ink-accommodating tube, is discharged through the open rear end of the ink-accommodating tube by applying centrifugal force on the ink on a centrifuge, the flow of air staying in a space in front of the regulating member is not obstructed by the regulating member, and air can surely be discharged. Therefore, air will not block the ink passage and hence the flow of the ink is not obstructed by the entrapped air.

DETAILED DESCRIPTION OF THE INVENTION

Figure 1:
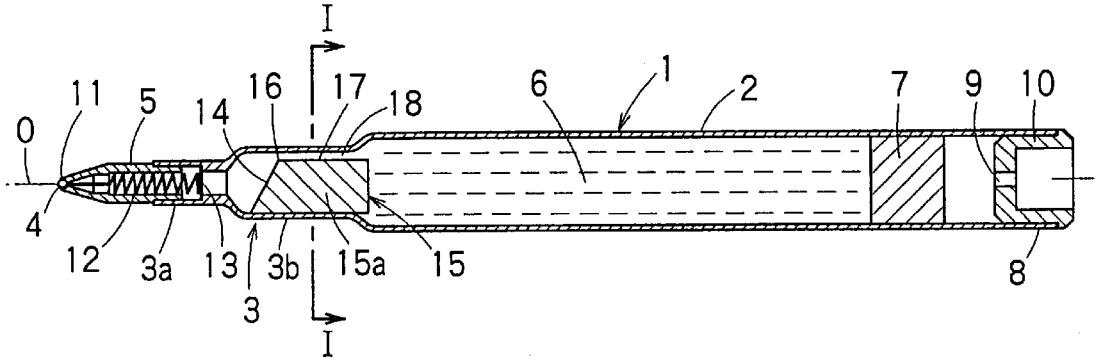
FIG. 1 is a longitudinal sectional view of a ballpoint pen refill in a first embodiment according to the present invention.

Preferred embodiments of the present invention will be described with reference to the accompanying drawings, in which like parts are designated by the same reference characters.

Figure 2:
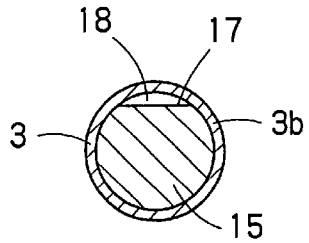
FIG. 2 is an enlarged end view taken on line I—I in FIG. 1.

FIGS. 1 and 2 shows a ballpoint pen refill in a first embodiment according to the present invention. The ballpoint pen refill has an ink-accommodating tube 1 formed of a metal. The ink-accommodating tube 1 has a small diameter portion 3 and a large diameter portion having a diameter that is greater than that of the small diameter portion 3. The large diameter portion 2 extends rearward from the small diameter portion 3.

The small diameter portion 3 has a thin section 3*a* in which a ballpoint pen tip 5 is inserted, and a medium section 3*b* connecting the thin section 3*a* and the large diameter portion 2. The ballpoint pen tip 5 rotatably holding a ball 4 is press-fitted in a front end portion of the thin section 3*a*. The ballpoint pen refill in the first embodiment has a three-section shape.

An ink 6 having a thixotropic property is filled in the ink-accommodating tube 1, and a greaselike ink follower 7 is filled in the ink-accommodating tube 1 so as to be contiguous with the rear end of the ink 6 having a thixotropic property. The ink follower 7 moves together with the ink 6 as the ink 6 is consumed and prevents the reverse flow of the ink 6. An end plug 10 with a vent hole 9, which connects the interior of the ink-accommodating tube 1 to the exterior of the same, is fitted in an open rear end portion 8 of the ink-accommodating tube 1.

A coil spring 12 is disposed in the ballpoint pen tip 5 so as to press the ball 4 closely to the inner surface of a front end portion 11 when the ballpoint tip refill is not in use. The rear end of the coil spring 12 rests on a stepped holding portion 13 formed in the inner surface of the thin section 3*a* of the small diameter portion 3. Although the front end of the coil spring 12 is in direct contact with the ball 4 in this embodiment, a pressing piece may be interposed between the ball 4 and the coil spring 12.

The ballpoint pen refill in this embodiment is provided with a regulating member 15 having a column 15*a* press-fitted in the medium section 3*b* of the small diameter portion 3. The front end of the column 15*a* of the regulating member 15 is formed as an inclined end surface 14 which is at a predetermined angle to a plane perpendicular to the center axis 0 of the ink-accommodating tube 1.

The predetermined angle of inclination of the inclined end surface 14 is determined taking the magnitude of centrifugal force to be exerted in a direction parallel to the center axis 0 of the ink-accommodating tube 1 on the ink in a deaerating process for removing air entrapped in the ink-accommodating tube 1 from the ink-accommodating tube 1 and the viscosity of the ink 6 filled in the ink-accommodating tube 1 into consideration so that air is not restrained from flowing by the inclined end surface in the deaerating process.

A portion of the side surface 17 between the rear end of the inclined end surface 14 on the front end edge 16 and the rear end of the column 15*a* is cut in a flat surface to form a fluid passage 18 between the column 15*a* and the inner surface of the medium section 3*b*. The ink 6 and air are able to flow through the fluid passage 18.

When the ballpoint pen refill is mounted on the rotating member of a centrifuge, not shown, with the ballpoint pen tip 5 directed radially outward. The rotating member of the centrifuge is rotated to remove air, which was entrapped in the ink-accommodating tube 1 in the process of filling the ink having a thixotropic property and the greaselike ink 6 follower 7 in the ink-accommodating tube 1, from the ink-accommodating tube 1. Air staying in the ballpoint pen tip 5 flows toward the open rear end 8 as the ink 6 is moved toward the ballpoint pen tip 5 by centrifugal force.

Air flows along the inclined end surface 14 of the regulating member 15 and reaches the fluid passage 18. Further, air flows through the fluid passage 18 into the large diameter portion 2 of the ink-accommodating tube 1. Then, air flows through the large diameter portion 2 and escapes outside through the open rear end 8.

When the ballpoint pen refill is impacted and the ink-accommodating tube 1 and the ink 6 are forced to move relative to each other, force resulting from the weight of the ink 6 is borne by the regulating member 15.

Since the ballpoint pen refill in the first embodiment is provided with the regulating member 15, any force resulting from the weight of the ink 6 does not act on the ball 4 even if the ink-accommodating tube 1 and the ink 6 are forced to move relative to each other by an impulsive force exerted on the ballpoint pen refill.

When discharging air, which was entrapped in the ink 6 in the process of filling the ink 6 having a thixotropic property and the greaselike ink follower 7 in the ink-accommodating tube 1, through the open rear end 8 of the ink-accommodating tube 1 by using the centrifuge, the flow of air staying in front of the regulating member 15 is not obstructed by the regulating member 15. The entrapped air can surely be discharged outside. Therefore, the ink passage in the ballpoint pen tip 5 will not be blocked by air remaining in the ballpoint pen tip 5 and hence unsatisfactory flow of ink will not be caused.

Figure 3:
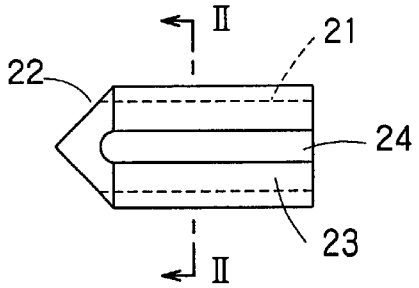
FIG. 3 is a side elevation of a regulating member employed in a modification of the ballpoint pen refill shown in FIG. 1.
Figure 4:
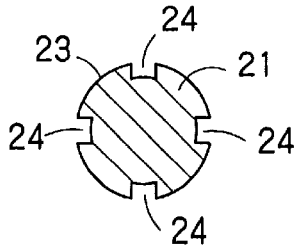
FIG. 4 is an enlarged end view taken on line II—II in FIG. 3.

A ballpoint pen refill in a modification of the first embodiment will be described hereinafter. FIGS. 3 and 4 show a regulating member 21 employed in the ballpoint pen refill in the modification. The regulating member 21, similarly to the regulating member 15 of the first embodiment, is cylindrical and has a inclined end surface. The inclined end surface of the regulating member 21 is formed as a convex conical surface 22 which is projecting from the front end of the regulating member 21. Four grooves are formed in the side surface 23 of the regulating member 21 at equal angular intervals of 90° to form fluid passages 24. The fluid passages 24 extend linearly between the front and the rear end of the regulating member 21, and the ink and air are able to flow through the fluid passages 24.

In this modification, the regulating member 21 is employed instead of the regulating member 15 of the first embodiment and is press-fitted in the medium section 3*b*. When the ballpoint pen refill is turned on the centrifuge to remove air from the ink-accommodating tube 1, air staying in the ballpoint pen tip 5 flows along the conical surface 22 and the fluid passages 24 into the large diameter portion 2 of the ink-accommodating tube 1 extending behind the regulating member 21. Then, air is discharged outside through the open rear end 8 of the ink-accommodating tube 1.

A ballpoint pen refill in a second embodiment according to the present invention will be described.

Figure 5:
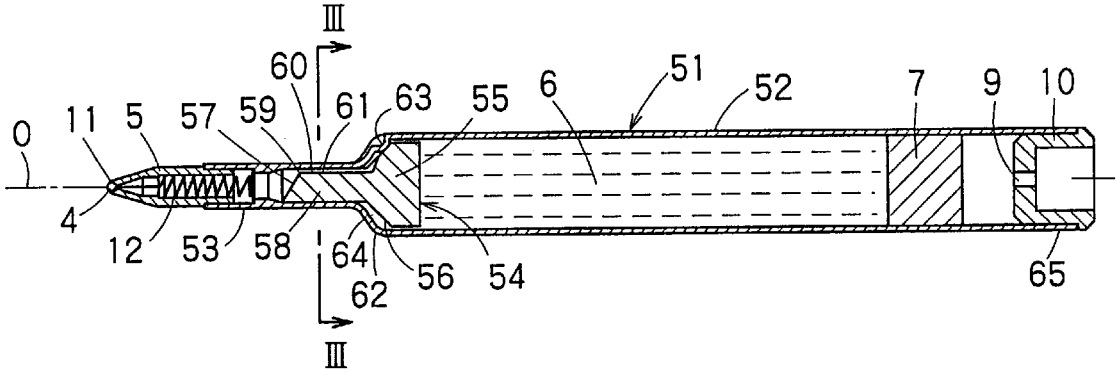
FIG. 5 is a longitudinal sectional view of a ballpoint pen refill in a second embodiment according to the present invention.
Figure 6:
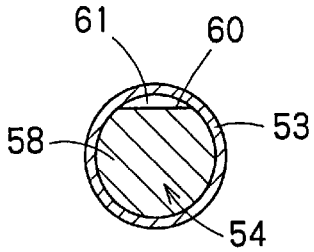
FIG. 6 is an enlarged end view taken on line III—III in FIG. 5.

FIGS. 5 and 6 show the ballpoint pen refill in the second embodiment. The ballpoint pen refill in the second embodiment is similar in construction to the ballpoint pen refill in the first embodiment, except that the ballpoint pen refill in the second embodiment has an ink-accommodating tube 51 having a small diameter portion 53 different in construction from that of the first embodiment, and a regulating member 54 different in construction from that of the first embodiment.

The small diameter portion 53 of the ink-accommodating tube 51 is of a single-section construction different from the small diameter portion of a two-section construction of the first embodiment.

The regulating member 54 disposed in the ink-accommodating tube 51 has a column 58 press-fitted in the small diameter portion 53, and a main portion 55 extending behind the column 58. The main portion 55 has a diameter smaller than the inside diameter of a large diameter portion 52 of the ink-accommodating tube 51 and greater than the diameter of the column 58, and a tapered portion 56 extending between the column 58 and the main portion 55.

The front end of the column 58 is beveled in an inclined end surface 57 inclined at a predetermined angle to a plane perpendicular to the center axis 0 of the ink-accommodating tube 1. The angle of inclination of the inclined end surface 57 of the column 58 is determined taking the magnitude of centrifugal force to be exerted in a direction parallel to the center axis 0 of the ink-accommodating tube 51 on an ink 6 filled in the ink-accommodating tube 51 in a deaerating process for removing air entrapped in the ink-accommodating tube 51 from the ink-accommodating tube 51 and the viscosity of the ink 6 filled in the ink-accommodating tube 51 into consideration so that air is not restrained from flowing by the inclined end surface 57 in the deaerating process.

A portion of the side surface 60 between the rear end of the inclined end surface 57 on the front end edge 59 and a portion of the tapered portion 56 of the column 58 is linearly cut to form a fluid passage 61 between the column 58 and the inner surface of the small diameter portion 53. The ink 6 and entrapped air are able to flow through the fluid passage 61.

Figure 7:
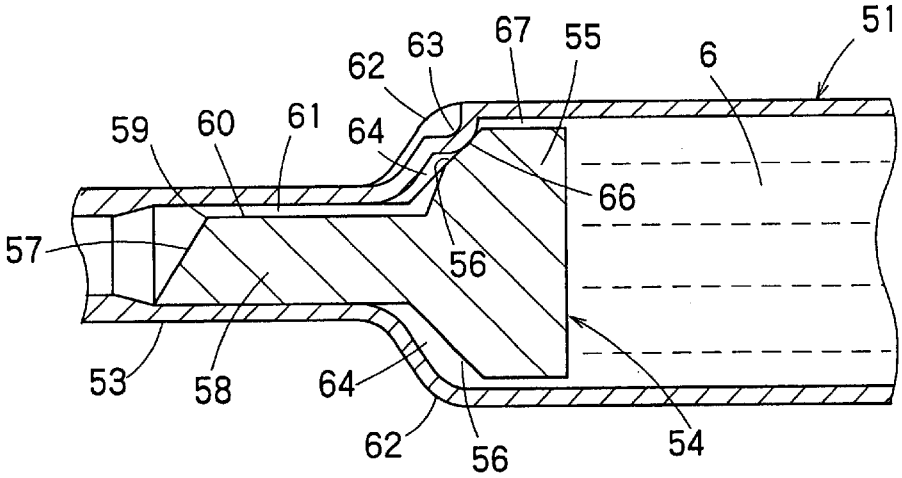
FIG. 7 is an enlarged fragmentary longitudinal sectional view of a portion of the ballpoint pen refill shown in FIG. 5 around a tapered portion.

As shown in an enlarged sectional view in FIG. 7, the ink-accommodating tube 51 has a shoulder portion 62 provided with a recess 63. The shoulder portion 62 extends between the large diameter portion 52 and the small diameter portion 53. When the ink-accommodating tube 51 is inserted in a barrel, not shown, air filling the barrel is able to flow through the recess 63 toward an end plug 10. A projection 66 is formed in the inner surface of the shoulder portion 62 of the ink-accommodating tube 51 at a position corresponding to the recess 63.

When the column 58 of the regulating member 54 is press-fitted in the small diameter portion 53, a part of the surface of the tapered portion 56 comes into contact with the projection 66, so that a space 64 is formed between the inner surface of the ink-accommodating tube 51 and the surface of the tapered portion 56.

A space extending in front of the regulating member 54 communicates with a space extending behind the regulating member 54 by means of the fluid passage 61, the space 64 and a gap 67 between the main portion 55 of the regulating member 54 and the inner surface of the ink-accommodating tube 51.

The ballpoint pen refill is mounted on the rotating member of a centrifuge, not shown, with the ballpoint pen tip 5 directed radially outward. The rotating member of the centrifuge is rotated to remove air, which was entrapped in the ink-accommodating tube 51 in the process of filling the ink 6 having a thixotropic property and the greaselike ink follower 7 in the ink-accommodating tube 51, from the ink-accommodating tube 51. Air staying in the ballpoint pen tip 5 flows toward the open rear end 65 as the ink 6 is moved toward the ballpoint pen tip 5 by centrifugal force.

Air flows along the inclined end surface 57 of the regulating member 54 and reaches the fluid passage 61. Further, air flows through the fluid passage 61 into the large diameter portion 52 of the ink-accommodating tube 51. Then, the ink 6 flows through the large diameter portion 52 and escapes outside through the open rear end 65.

When the ballpoint pen refill is impacted and the ink-accommodating tube 1 and the ink 6 are forced to move relative to each other, force resulting from the weight of the ink 6 is borne by the regulating member 54.

Since the ballpoint pen refill in the first embodiment is provided with the regulating member 54, any force resulting from the weight of the ink 6 does not act on the ball 4 even if the ink-accommodating tube 51 and the ink 6 are forced to move relative to each other by an impulsive force exerted on the ballpoint pen refill.

When discharging air, which was entrapped in the ink 6 having a thixotropic property in the process of filling the ink 6 having a thixotropic property and the greaselike ink follower 7 in the ink-accommodating tube 51, through the open rear end 65 of the ink-accommodating tube 51 by mounting the ballpoint pen refill on the rotor of a centrifuge with the ballpoint pen tip 5 directed radially outward and rotating the rotor of the centrifuge to force the ink toward the ballpoint pen tip 5 by centrifugal force, entrapped air moves toward open rear end 65.

Air flows along the inclined end surface 57 of the regulating member 54 into the fluid passage 61. Then, air flows through the space 64 and the gap 67 into the large diameter portion 52 of the ink-accommodating tube 51 extending behind the regulating member 54 and is discharged outside of the ink-accommodating tube 51 through the open rear end 65.

When the ballpoint pen refill is impacted and the ink-accommodating tube 51 and the ink 6 are forced to move relative to each other, force resulting from the weight of the ink 6 is borne by the regulating member 54.

Since the ballpoint pen refill in the second embodiment is provided with the regulating member 54, any force resulting from the weight of the ink 6 does not act on the ball 4 of the ballpoint pen tip 5 even if the ink-accommodating tube 51 and the ink 6 are forced to move relative to each other by an impulsive force exerted on the ballpoint pen refill.

When air, which was entrapped in the ink 6 having a thixotropic property in the process of filling the ink 6 having a thixotropic property and the greaselike ink follower 7 in the ink-accommodating tube 51, is discharged through the open rear end 65 of the ink-accommodating tube 51 by turning the ballpoint pen refill on the centrifuge, the flow of air staying in front of the regulating member 54 is not obstructed by the regulating member 54. The entrapped air can surely be discharged outside. Therefore, the ink passage in the ballpoint pen tip 5 will not be blocked by air remaining in the ballpoint pen tip 5 and hence unsatisfactory flow of ink will not be caused.

Figure 8:
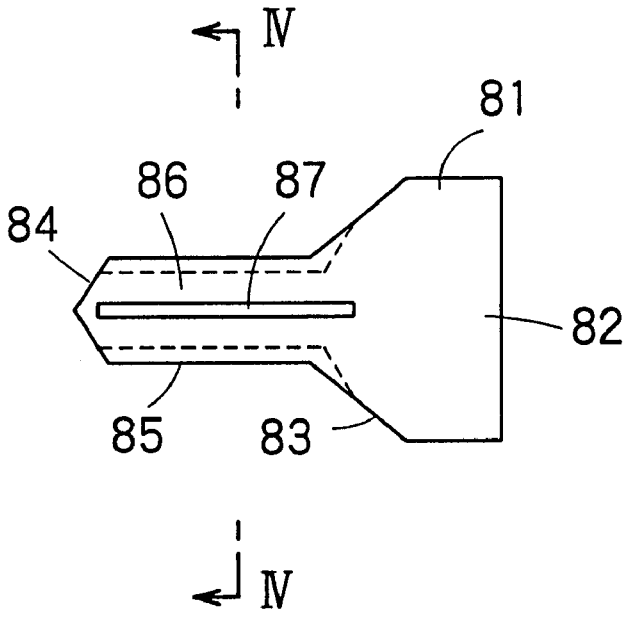
FIG. 8 is a side elevation of a regulating member employed in a modification of the ballpoint pen refill shown in FIG. 5.
Figure 9:
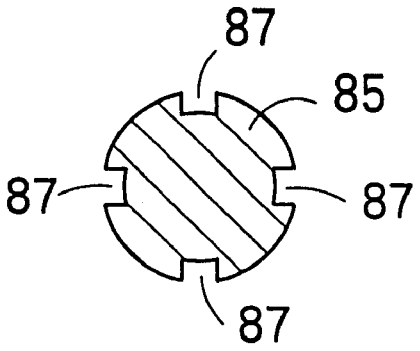
FIG. 9 is an enlarged end view taken on line IV—IV in FIG. 8.

A ballpoint pen refill in a modification of the second embodiment will be described hereinafter. FIGS. 8 and 9 show a regulating member 81 employed in the ballpoint pen refill in the modification. The regulating member 81, similarly to the regulating member 54 of the second embodiment, has main portion 82, a tapered portion 83 and a column 85.

The inclined end surface of the regulating member 81 in this modification is formed as a convex conical surface 84 which extends from the front end of the column 85. Four grooves are formed in the side surface 86 of the regulating member 81 at equal angular intervals of 90° about the center axis 0 of the ink containing tube 51 aligned with the center axis of the regulating member 81 to form fluid passages 87. The fluid passages 87 extend linearly between the front end of the column 85 and a portion of the tapered portion 83, and the ink and air are able to flow through the fluid passages 87.

In this modification, the regulating member 81 is employed instead of the regulating member 54 of the second embodiment. The regulating member 81 is inserted in the ink-accommodating tube 51. A space extending in front of the regulating member 81 communicates with a space extending behind the regulating member 81 by means of the fluid passage 87, the space 64 and a gap 67.

When the ballpoint pen refill is turned on the centrifuge to remove air from the ink-accommodating tube 51, air staying in the ballpoint pen tip 5 flows along the conical surface 84 and reaches the fluid passages 87. Further, air flows through the fluid passages 87, the space 64 and the gap 67 into the large diameter portion 52 of the ink-accommodating tube 51 extending behind the regulating member 81. Then, air is discharged outside through the open rear end 65 of the ink-accommodating tube 51.

INDUSTRIAL APPLICABILITY

The present invention is applicable to a variety of ballpoint pen refills containing an ink having a thixotropic property.

What is claimed is:

1. A ballpoint pen refill comprising:

an ink-accommodating tube for containing an ink having a thixotropic property, said ink-accommodating tube having a small diameter portion formed at a front side of said ink-accommodating tube, and a large diameter portion formed at a rear side of said ink-accommodating tube, wherein said large diameter portion has a diameter that is greater than a diameter of said small diameter portion;

a greaselike ink follower disposed in said ink-accommodating tube, said follower being adapted to move as the ink is consumed and to prevent a reverse flow of the ink;

a ballpoint pen tip inserted in a front end of the small diameter portion of said ink-accommodating tube, said ballpoint pen tip including a rotatable ball; and a regulating member having a column portion that is press-fitted in the small diameter portion of said ink-accommodating tube, wherein the column portion of said regulating member includes a front end surface that is inclined at a predetermined angle relative to a plane that is perpendicular to an axis of said ink-accommodating tube, and substantially the entire surface of said front end surface is inclined, and wherein a fluid passage extends rearwardly from a rear end of the inclined front end surface, and along a side surface of the column portion so as to allow the ink and air in said ink-accommodating tube to flow therethrough.

2. The ballpoint pen refill as claimed in claim 1, wherein the predetermined angle is determined by taking into consideration a magnitude of a centrifugal force to be exerted in a direction that is parallel to the axis of said ink-accommodating tube on the ink in a deaerating process for removing air entrapped in said ink-accommodating tube, and a viscosity of the ink so that the air is not restrained from flowing by the inclined forward end surface in the deaerating process.

3. The ballpoint pen refill as claimed in claim 2, wherein said regulating member includes a main portion located behind the column portion, and a tapered transitional portion connecting the column portion and the main portion, wherein said main portion has a diameter that is smaller than an inside diameter of said ink-accommodating tube and greater than a diameter of the column portion, and wherein the fluid passage extends from the rear end of the inclined front end surface through the side surface of the column portion and beyond a rear end of the column portion.

4. The ballpoint pen refill as claimed in claim 2, wherein the inclined front end surface comprises a flat surface.

5. The ballpoint pen refill as claimed in claim 2, wherein the inclined front end surface comprises a convex conical surface projecting in a forward direction.

6. The ballpoint pen refill as claimed in claim 1, wherein said regulating member includes a main portion located behind the column portion, and a tapered transitional portion connecting the column portion and the main portion, wherein said main portion has a diameter that is smaller than an inside diameter of said ink-accommodating tube and greater than a diameter of the column portion, and wherein the fluid passage extends from the rear end of the inclined end surface through the side surface of the column portion and beyond a rear end of the column portion.

7. The ballpoint pen refill as claimed in claim 6, wherein the inclined front end surface comprises a flat surface.

8. The ballpoint pen refill as claimed in claim 6, wherein the inclined front end surface comprises a convex conical surface projecting in a forward direction.

9. The ballpoint pen refill as claimed in claim 1, wherein the inclined front end surface comprises a flat surface.

10. The ballpoint pen refill as claimed in claim 1, wherein the inclined surface comprises a convex conical surface projecting from the front end of the column portion.

11. The ballpoint pen refill as claimed in claim 10, wherein said regulating member includes a plurality of fluid passages extending rearwardly from a rear end of the convex conical surface.

12. The ballpoint pen refill as claimed in claim 11, wherein the fluid passages are arranged in an outer peripheral surface of the column portion at equal angular intervals about the axis of said ink-accommodating tube.

13. The ballpoint pen refill as claimed in claim 1, further comprising a coil spring for pressing the ball forward so as to press the ball against an inner surface of a front end of said ballpoint pen tip.

14. The ballpoint pen refill as claimed in claim 1, wherein the small diameter portion of said ink-accommodating tube has a reduced diameter section in which said ballpoint pen tip is inserted, a medium section having a diameter that is greater than a diameter of the reduced diameter section and smaller than the diameter of the large diameter portion, said medium section connecting the reduced diameter section and the large diameter portion, and the column portion of said regulating member is press-fitted in the medium section of the small diameter portion.

15. The ballpoint pen refill as claimed in claim 1, further comprising an end plug fitted in an open rear end of said ink-accommodating tube, wherein said plug has a vent hole.

16. A ballpoint pen refill comprising:

an ink-accommodating tube containing ink having a thixotropic property, said ink-accommodating tube having a small diameter portion formed at a front side of said ink-accommodating tube, and a large diameter portion formed at a rear side of said ink-accommodating tube, wherein said large diameter portion has a diameter that is greater than a diameter of said small diameter portion;

a greaselike ink follower disposed in said ink-accommodating tube, wherein said follower is adapted to move as the ink is consumed and to prevent a reverse flow of the ink;

a ballpoint pen tip inserted in a front end of said small diameter portion of said ink-accommodating tube, said ballpoint pen tip including a rotatable ball; and a regulating member having a column portion that is press-fitted in said small diameter portion, a main portion located behind the column portion, and a tapered transitional portion connecting the column portion and the main portion, wherein a front end surface of the column portion is inclined at a predetermined angle relative to a plane that is perpendicular to an axis of said ink-accommodating tube, wherein the main portion of said regulating member has a diameter that is less than an inside diameter of said ink-accommodating tube and greater than a diameter of the column portion of said regulating member, wherein the tapered transitional portion is positioned in said ink-accommodating tube so as to not be in close contact with an inner surface of said ink-accommodating tube, and wherein a fluid passage extends rearwardly from a rear end of the inclined front end surface, along a side surface of the column portion to at least a portion of the tapered transitional portion in order to allow the ink and any air in said ink-accommodating tube to flow through the fluid passage.

17. The ballpoint pen refill as claimed in claim 16, wherein said ink-accommodating tube comprises:

a shoulder portion forming a transitional portion between the small diameter portion and the large diameter portion;

a recess formed on an outside surface of the shoulder portion;

a projection formed on the inner surface of said ink-accommodating tube at a position corresponding to the recess, wherein the tapered transitional portion contacts the projection so that a space is formed between the inner surface of said ink-accommodating tube and a surface of the tapered transitional portion.

18. The ballpoint pen refill as claimed in claim 17, wherein the inclined front end surface of the column portion comprises a flat surface.

19. The ballpoint pen refill as claimed in claim 16, wherein the inclined front end surface of the column portion comprises a flat surface.

20. The ballpoint pen refill as claimed in claim 16, wherein the inclined front end surface of the column portion comprises a convex conical surface that projects in a forward direction.

* * * * *